US011545125B1

(12) United States Patent
Chang et al.

(10) Patent No.: US 11,545,125 B1
(45) Date of Patent: Jan. 3, 2023

(54) ELECTRONIC SYSTEM WITH HEAT DISSIPATION AND FEED-FORWARD ACTIVE NOISE CONTROL FUNCTION AND RELATED METHOD

(71) Applicant: ACER INCORPORATED, New Taipei (TW)

(72) Inventors: Jia-Ren Chang, New Taipei (TW); Ruey-Ching Shyu, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/528,172

(22) Filed: Nov. 16, 2021

(30) Foreign Application Priority Data

Aug. 19, 2021 (TW) ..... 110130661

(51) Int. Cl.
*G10K 11/178* (2006.01)
*F04D 29/66* (2006.01)
*F04D 27/00* (2006.01)

(52) U.S. Cl.
CPC ..... *G10K 11/17825* (2018.01); *F04D 27/00* (2013.01); *F04D 29/661* (2013.01); *G10K 2210/11* (2013.01)

(58) Field of Classification Search
CPC ..... G10K 2210/11; G10K 11/17825
See application file for complete search history.

(56) References Cited

U.S. PATENT DOCUMENTS 7,894,613 B1 * 2/2011 Ong ..... G10K 11/17857 381/71.7
10,133,321 B1 * 11/2018 Bhopte ..... H05K 7/20145
2005/0094823 A1 * 5/2005 Kobori ..... G10K 11/17823 381/71.5
2007/0223715 A1 * 9/2007 Barath ..... G10K 11/17857 381/71.7
2009/0034746 A1 * 2/2009 Nozaki ..... G10K 11/1783 381/71.1
2010/0002385 A1 * 1/2010 Lyon ..... G10K 11/17885 361/695
2013/0272534 A1 * 10/2013 Costa ..... G10K 11/16 381/71.3
2017/0276398 A1 * 9/2017 Hanazono ..... G10K 11/17825

FOREIGN PATENT DOCUMENTS

CN 111145715 A 5/2020
CN 111630589 A 9/2020

* cited by examiner

*Primary Examiner* — David L Ton
(74) *Attorney, Agent, or Firm* — Winston Hsu

(57) ABSTRACT

An electronic system includes a fan module, an embedded controller, an error microphone, an active noise cancellation controller, and a micro speaker module. The error microphone is configured to output an error signal by detecting the noise level during the operation of the electronic system. According to the error signal and the fan information provided by the embedded controller, the active noise cancellation controller calculates the narrow-band noises associated with the actual single-blade fundamental frequency noise and the actual BPF fundamental frequency noise generated by the fan module, and drives the micro speaker module accordingly for providing a noise cancellation signal. The error signal may be reduced to zero by adaptively adjusting the noise cancellation signal for canceling the noises generated during the operation of the electronic system.

10 Claims, 3 Drawing Sheets

ELECTRONIC SYSTEM WITH HEAT DISSIPATION AND FEED-FORWARD ACTIVE NOISE CONTROL FUNCTION AND RELATED METHOD

CROSS REFERENCE TO RELATED APPLICATION

This application claims priority of Taiwan Application No. 110130661 filed on 2021 Aug. 19.

BACKGROUND OF THE INVENTION

1. Field of the Invention

The present invention is related to an electronic system with heat dissipation and feed-forward active noise control function and a related method, and more particularly, to an electronic system with heat dissipation and feed-forward active narrow-band noise control function and a related method.

2. Description of the Prior Art

Computer systems have been widely used in modern society. Computer components depend on the passage of electric current to process information. The current flow through the resistive elements of the computer components is accompanied by heat dissipation. The essence of thermal design is the safe removal of this internally generated heat which may jeopardize the components safety and reliability. An electronic system normally adopts a fan capable of accelerating the exchange of air for heat dissipation purpose.

The rotational speed and the static pressure of a fan determine the volume of air which the fan delivers per minute or per hour. The noise generated during the operation of the fan is roughly proportional to the fan speed to the power of 5. More efficient heat dissipation can be achieved using a faster fan speed, but with the main drawback of generating more noises. The trend of adopting more powerful central processing units (CPUs) and miniaturization increase the amount of heat produced per unit area of the components. Therefore, there is a need of addressing the issues of heat dissipation and noise reduction at the same time.

SUMMARY OF THE INVENTION

The present invention provides an electronic system with heat dissipation and feed-forward active noise control function. The electronic system includes a fan module, an embedded controller, an error microphone, an active noise cancellation controller, and a micro speaker module. The fan module is configured to operate according to a fan control signal for providing heat dissipation. The embedded controller is configured to provide the fan control signal and a synchronization signal which includes information associated with a structure and an operational setting of the fan module. The error microphone is configured to detect a noise level during an operation of the electronic system and output a corresponding error signal. The active noise cancellation controller is configured to acquire an actual single-blade fundamental frequency and an actual blade passing frequency fundamental frequency of the fan module during operation, and provide a speaker control signal according to the actual single-blade fundamental frequency and the actual BPF fundamental frequency. The micro speaker module is configured to generate a cancellation noise signal according to the speaker control signal. The cancellation noise signal includes a first noise compensation signal and a second noise compensation signal. The first noise compensation is a cancellation signal associated with the actual single-blade fundamental frequency. The second noise compensation is a cancellation signal associated with the actual BPF fundamental frequency.

The present invention also provides a method of providing heat dissipation and feed-forward active noise control function in an electronic system. The method includes a fan module in the electronic system operating according to a fan control signal for providing heat dissipation; an embedded controller in the electronic system providing the fan control signal and a synchronization signal which includes information associated with a structure and an operational setting of the fan module; an error microphone in the electronic system detecting a noise level during an operation of the electronic system and outputting a corresponding error signal; an active noise cancellation controller in the electronic system acquiring an actual single-blade fundamental frequency and an actual BPF fundamental frequency of the fan module during operation; the active noise cancellation controller providing a speaker control signal according to the actual single-blade fundamental frequency and the actual BPF fundamental frequency; and a micro speaker module in the electronic system generating a cancellation noise signal according to the speaker control signal. The cancellation noise signal includes a first noise compensation signal and a second noise compensation signal. The first noise compensation is a cancellation signal associated with the actual single-blade fundamental frequency. The second noise compensation is a cancellation signal associated with the actual BPF fundamental frequency.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
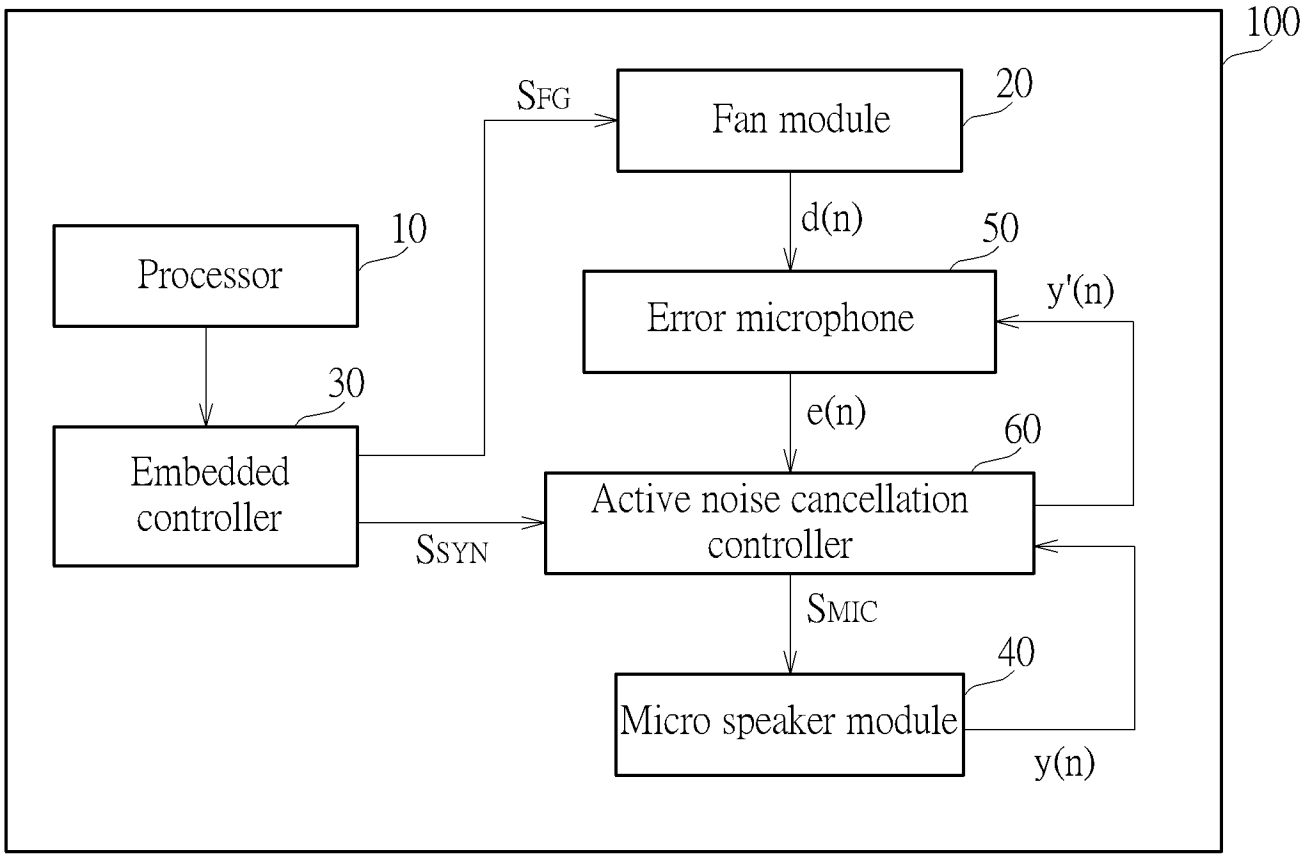
FIG. 1 is a functional diagram illustrating an electronic system with heat dissipation and feed-forward active noise control function according to an embodiment of the present invention.

FIG. 1 is a functional diagram illustrating an electronic system 100 with heat dissipation and feed-forward active noise control function according to an embodiment of the present invention. The electronic system 100 includes a processor 10, a fan module 20, an embedded controller (EC) 30, a micro speaker module 40, an error microphone 50, and an active noise cancellation (ANC) controller 60.

The processor 10 may be a central processing unit (CPU) or a graphic processing unit (GPU). As the key engine of executing commands and procedures for running the operating system, the processor 10 is the main source of generating waste heat in the electronic system 100.

The fan module 20 may have different structures depending on its module. Basically speaking, the fan blades are driven by a motor into rotation for drawing cool air into the housing and pushing out warm air for heat dissipation purpose. In the present invention, the fan module 20 is configured to operate according to a fan control signal $S_{FG}$ provided by the embedded controller 30. A larger value of the fan control signal $S_{FG}$ results in a faster rotational speed of the motor in the fan module 20. More efficient heat dissipation can be achieved by increasing the rotational speed of the motor in the fan module 20, but with the main drawback of raising the noise level. During the operation of the electronic system 100, the fan module 20 is the main source of generating noises. In an embodiment, the fan control signal $S_{FG}$ may be a pulse width modulation (PWM) square wave which can be used to adjust the motor speed of the fan module 20 by varying its duty cycle. In an embodiment, the fan module 20 may include one or multiple axial fans or centrifugal fans. However, the number, the type and the driving method of the fans in the fan module 20 do not limit the scope of the present invention.

The embedded controller 30 may store the EC code of each task and timing constraints of the boot process. In the turned-off state, the embedded controller 30 continues to operate for awaiting the wake-up message from the user. In the turned-on state, the embedded controller 30 is configured to control the standby/hibernate mode, the keyboard controller, the charge indicator and the motor speed of the fan module 20. The embedded controller 30 normally includes a thermal sensor (not shown in FIG. 1) for monitoring the operational temperature of the processor 10, thereby outputting the fan control signal $S_{FG}$ accordingly. When the operational temperature of the processor 10 raises, the duty cycle of the fan control signal $S_{FG}$ is increased accordingly for increasing the motor speed of the fan module 20; when the operational temperature of the processor 10 drops, the duty cycle of the fan control signal $S_{FG}$ is decreased accordingly for reducing the motor speed of the fan module 20.

The micro speaker module 40 is an electronic component capable of converting electronic signals into audio signals and normally includes diaphragms and a control circuit made of electromagnets and coils. The micro speaker module 40 is configured to operate according to a speaker control signal $S_{MIC}$ provided by the ANC controller 60. When the current of the speaker control signal $S_{MIC}$ flows through the coils in the micro speaker module 40, the coils vibrate in the same frequency of the current. The diaphragms attached to the coils also start to vibrate, thereby causing disturbance in surrounding air for producing sound. In an embodiment of the present invention, the diaphragms of the micro speaker module 40 are disposed inside the air venting structure of the fan module 20 and configured to generate a noise cancellation signal y(n) according to the speaker control signal $S_{MIC}$.

The error microphone 50 is configured to capture noises during the operation of the electronic system. 100 and output a corresponding error signal e(n) to the ANC controller 60, wherein the error signal e(n) indicates the noise level which is desirably to be reduced to zero. Since the fan module 20 is the main noise source, the error microphone 50 may be disposed near the air outlet of the fan module 20. The error microphone 50 may detect noises via a primary path and a secondary path. A noise signal d(n) may be detected by the error microphone 50 via the primary path which is associated with the signal transmission path between the fan module 20 and the error microphone 50. A calibrated noise cancellation signal y'(n) associated with the noise cancellation signal y(n) may be detected by the error microphone 50 via the secondary path which is associated with the signal transmission path between the micro speaker module 40 and the error microphone 50. More specifically, the error signal e(n) outputted by the error microphone 50 is the difference between the noise signal d(n) and the calibrated noise cancellation signal y' (n), and a smaller value of the error signal e(n) means better noise cancellation. In an embodiment, the error microphone 50 may be a micro electro mechanical system (MEMS) microphone characterized in high heat tolerance, high anti-vibration and high RF immunity. However, the type of the error microphone 50 does not limit the scope of the present invention.

The ANC controller 60 is configured to receive a synchronization signal $S_{SYN}$ from the embedded controller 30 and receive the error signal e(n) from the error microphone 50, wherein the synchronization signal $S_{SYN}$ includes the information associated with the structure of the fan module 20 (such as the number of blades in each fan) and the operational setting (such as the motor speed in different operational modes). Based on the synchronization signal $S_{SYN}$ and the error signal e(n), the ANC controller 60 may calculate the narrow-band noises among the noises generated by the fan module 20 during operation and provide the speaker control signal $S_{MIC}$ accordingly for driving the micro speaker module 40. This way, the noise signal d(n) may be effectively canceled by the noise cancellation signal y(n) provided by the micro speaker module 40, with the expectation to keep the error signal e(n) at zero.

Figure 2:
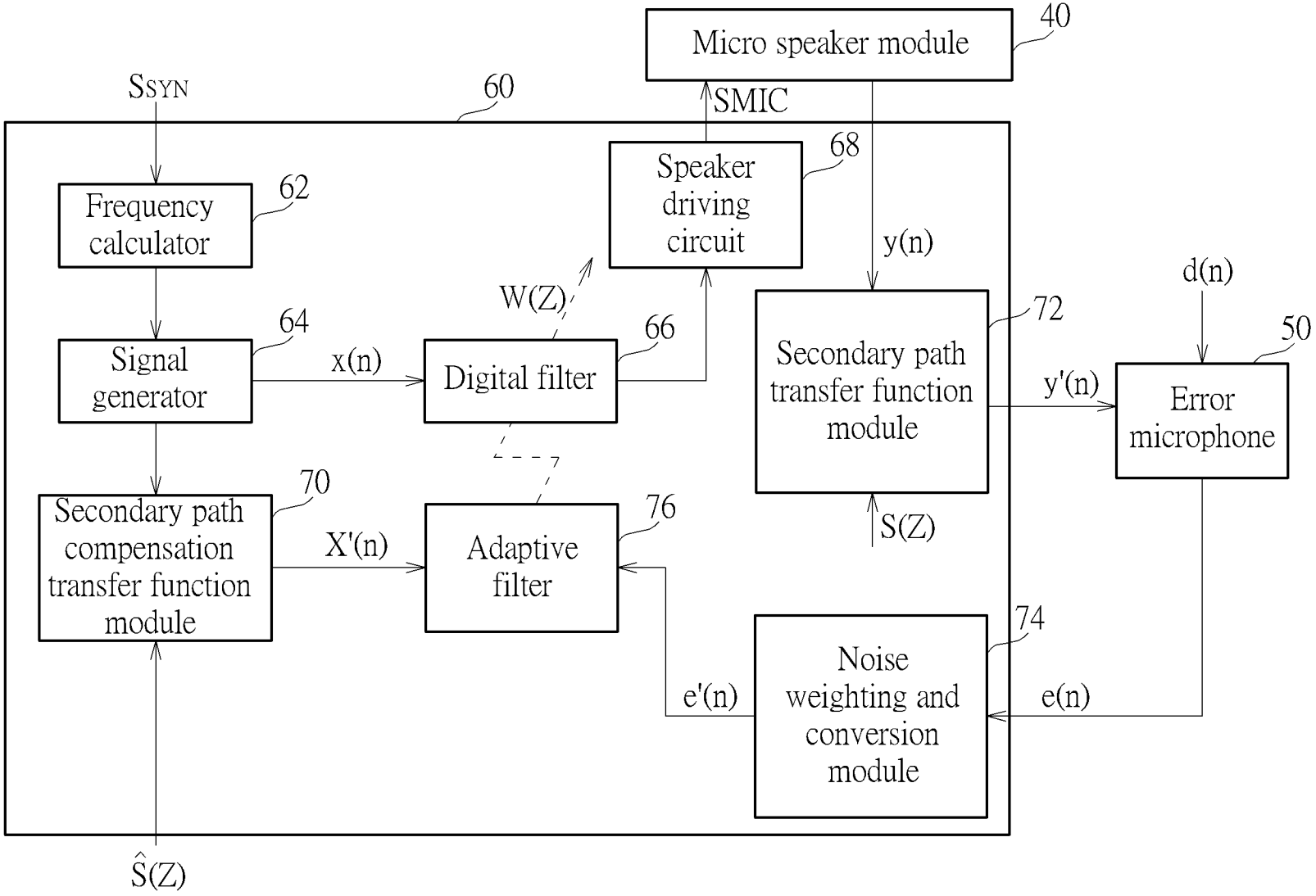
FIG. 2 is a diagram illustrating an implementation of the ANC controller in the electronic system according to an embodiment of the present invention.

FIG. 2 is a diagram illustrating an implementation of the ANC controller 60 in the electronic system 100 according to an embodiment of the present invention. The ANC controller 60 includes a frequency calculator 62, a signal generator 64, a digital filter 66, a speaker driving circuit 68, a secondary path compensation transfer function module 70, a secondary path transfer function module 72, a noise weighting and conversion module 74, and an adaptive filter 76.

Figure 3:
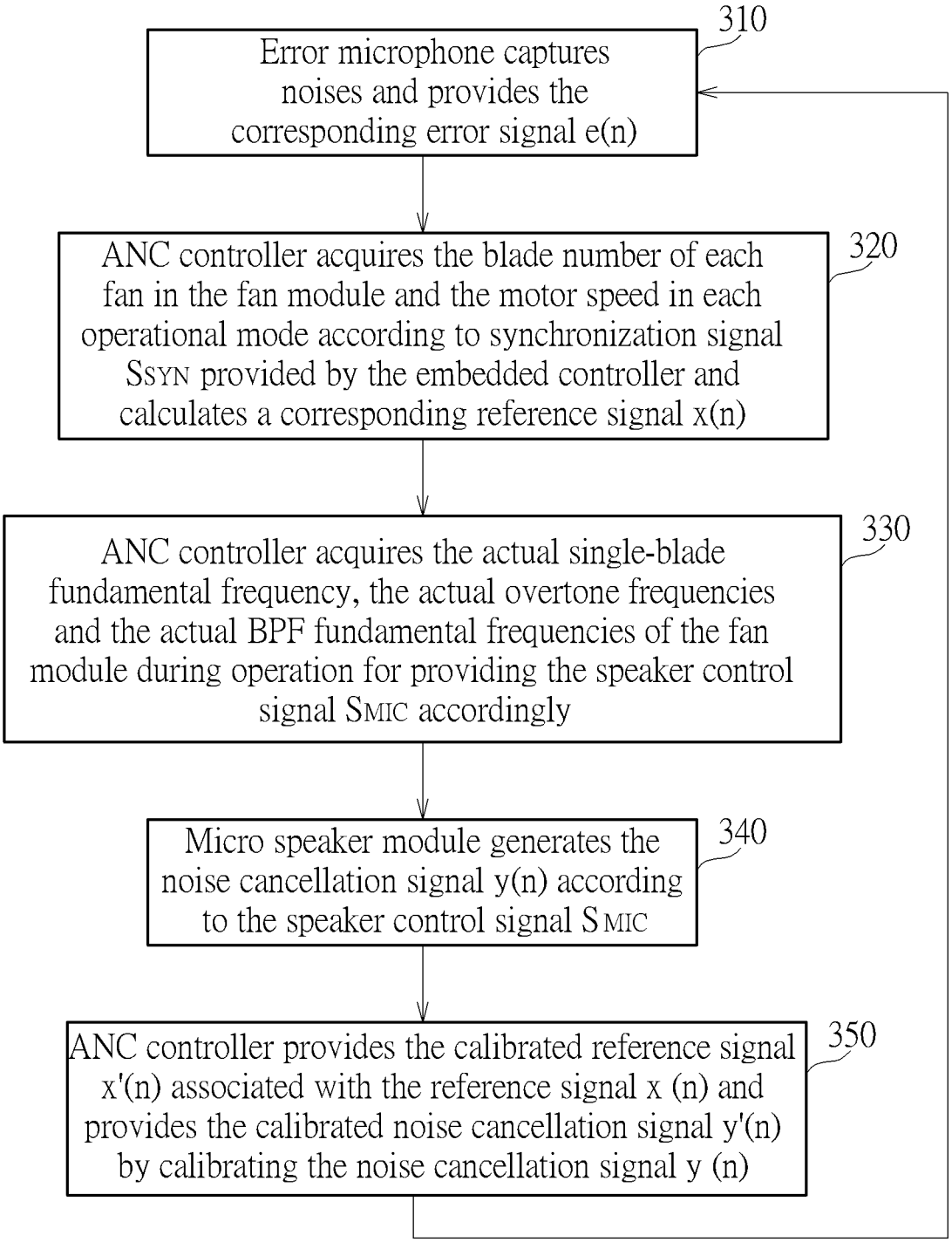
FIG. 3 is a flowchart illustrating an implementation of the ANC controller in the electronic system according to an embodiment of the present invention.

FIG. 3 is a flowchart illustrating an implementation of the ANC controller 60 in the electronic system 100 according to an embodiment of the present invention. The flowchart in FIG. 3 includes the following steps:

Step 310: the error microphone 50 captures noises and provides the corresponding error signal e(n).

Step 320: the ANC controller 60 acquires the blade number of each fan in the fan module 20 and the motor speed in each operational mode according to the synchronization signal $S_{SYN}$ provided by the embedded controller 30 and calculates a corresponding reference signal x(n).

Step 330: the ANC controller 60 acquires the actual single-blade fundamental frequency, the actual overtone frequencies and the actual blade passing frequency (BPF) fundamental frequencies of the fan module 20 during operation for providing the speaker control signal $S_{MIC}$ accordingly.

Step 340: the micro speaker module 40 generates the noise cancellation signal y(n) according to the speaker control signal $S_{MIC}$.

Step 350: the ANC controller 60 provides the calibrated reference signal x' (n) associated with the reference signal x (n) and provides the calibrated noise cancellation signal y'(n) by calibrating the noise cancellation signal y (n).

In step 310, the error microphone 50 is configured to capture the noises generated during the operation of the electronic system 100 and provide the corresponding error signal e(n). As previously stated, the error signal e(n) provided by the error microphone 50 is the difference between the noise signal d(n) and the calibrated noise cancellation signal y' (n), and the noise signal d(n) is mainly generated by the blade rotation of the fan module 20 during operation.

The noise source during the operation of the fan module 20 originates from the air flow caused by the rotation of the motor. The narrow-band component of the noises may be thickness noises or blade passing frequency (BPF) noises. Thickness noises are the result of the sound wave pulse created by the repetitive rotary motion of the air being displaced by the blade surface. BPF noises are caused by structural vibration (axial force and surface force) of the fan module 20. Since BPF and related harmonic waves are associated with the turbulent flow fluctuations as each fan blade passes a specific reference point, the periodic pressure wave at the tip of each fan blade generates a specific narrow-band noise. Therefore in step 320, the ANC controller 60 is configured to acquire the motor speed, the single-blade frequencies and the blade number of the fan module 20 according to the synchronization signal $S_{SYN}$ provided by the embedded controller 30, wherein the value of BPF is the multiple of the motor speed and the blade number of the fan module 20. Assuming that each fan in the fan module 20 has 37 blades, the following Table 1 illustrates the data calculated by the frequency calculator 62, but does not limit the scope of present invention. The motor speed is shown in rpm, and the frequency is shown in Hertz.

TABLE 1

| Motor speed | Fundamental frequency | $1^{st}$ | $2^{nd}$ overtone | $3^{th}$ | Blade number | BPF | BPF × 2 | BPF × 3 |
|---|---|---|---|---|---|---|---|---|
| 500 | 8.3 | 16.6 | 24.9 | 33.2 | 37 | 307.1 | 614.2 | 921.3 |
| 1000 | 16.6 | 33.2 | 49.8 | 66.4 | 37 | 614.2 | 1228.4 | 1842.6 |
| 1500 | 25 | 50 | 75 | 100 | 37 | 925 | 1850 | 2775 |
| 2000 | 33.3 | 66.6 | 99.9 | 133.2 | 37 | 1232.1 | 2464.2 | 3696.3 |
| 2500 | 41.7 | 83.4 | 125.1 | 166.8 | 37 | 1542.9 | 3085.8 | 4628.7 |
| 3000 | 50 | 100 | 150 | 200 | 37 | 1850 | 3700 | 5550 |
| 3500 | 58.3 | 116.6 | 174.9 | 233.2 | 37 | 2157.1 | 4314.2 | 6471.3 |
| 4000 | 66.7 | 133.4 | 200.1 | 266.8 | 37 | 2467.9 | 4935.8 | 7403.7 |
| 4500 | 75 | 150 | 225 | 300 | 37 | 2775 | 5550 | 8325 |
| 5000 | 83.3 | 166.6 | 249.9 | 333.2 | 37 | 3082.1 | 6164.2 | 9246.3 |
| 5500 | 91.6 | 183.2 | 274.8 | 366.4 | 37 | 3389.2 | 6778.4 | 10167.6 |
| 5700 | 95 | 190 | 285 | 380 | 37 | 3515 | 7030 | 10545 |

Next, the signal generator 64 in the ANC controller 60 is configured to generate the reference signal x(n) according to the data calculated by the frequency calculator 62, wherein the reference signal x(n) includes the information associated with the estimated overtones, the estimated BPF, and the sound pressure (dBSPL) under different motor speeds for determining the baseline power value of the speaker control signal $S_{MIC}$. The power value of the speaker control signal $S_{MIC}$ may be adjusted by varying the parameter W (Z) of the digital filter 66.

In steps 330 and 340, the digital filter 66 in the ANC controller 60 is configured to drive the speaker driving circuit 68 according to the error signal e (n) and the reference signal x (n) for outputting the speaker control signal $S_{MIC}$, thereby driving the micro speaker module 40 so as to provide the noise cancellation signal y (n), wherein W(Z) represents the adjustable parameter of the digital filter 66.

The intrinsic characteristics of the micro speaker module 40 and the white noise transmitted to the fan module 20 influence the secondary path between the micro speaker module 40 and the error microphone 50. The micro speaker module 40 is configured to provide the noise cancellation signal y(n) which is expected to exactly cancel the noise signal d (n). However, after signal transmission via the secondary path, the noise cancellation signal y(n) captured by the error microphone 50 may not be able to exactly cancel the noise signal d (n) due to signal attenuation. Therefore in step 350, the secondary path compensation transfer function module 70 in the ANC controller 60 is configured to acquire the estimated signal of the secondary path $\hat{S}$ (Z) from the embedded controller 30 and provide the calibrated reference signal x' (n) by calibrating the reference signal x (n) according to the estimated signal of the secondary path $\hat{S}$ (Z). The secondary path transfer function module 72 in the ANC controller 60 may be a spectrum analyzer configured to measure the actual frequency response of the secondary path S(Z) and provide the calibrated noise cancellation signal y' (n) by calibrating the noise cancellation signal y (n) according to the actual frequency response of the secondary path S(Z), thereby compensating the impact of signal attenuation caused by the secondary path.

The noise weighting and conversion module 74 is coupled to the error microphone 50 and configured to process the error signal e (n) measured by the error microphone 50 using a specific signal weighting method and a specific signal conversion method and then transmit the processed error signal e'(n) to the adaptive filter 76. In an embodiment, the noise weighting and conversion module 74 may process the error signal e(n) using A weighting method and Fast Fourier Transform (FFT) method. However, the signal weighting method or the signal conversion method adopted by the noise weighting and conversion module 74 does not limit the scope of the present invention.

The adaptive filter 76 is coupled to the secondary path compensation transfer function module 70 and the noise weighting and conversion module 74 and configured to process the calibrated reference signal x'(n) and the processed error signal e'(n) using a specific algorithm for adjusting the parameter W(Z) of the digital filter 66. More specifically, the calibrated reference signal x'(n) includes the information associated with motor speed, the estimated single-blade fundamental frequency and the estimated BPF of the fan module 20. The adaptive filter 76 is configured acquire the information related to narrow-band noises (such as the actual single-blade fundamental frequency, the actual overtones and the actual BPF of the fan module 20) according to the processed error signal e'(n) for adjusting the parameter W(Z) of the digital filter 66. This way, when the digital filter 66 drives the speaker driving circuit 68 for outputting the speaker control signal SMIC, the noise cancellation signal y(n) can reflect the actual operational status and the current noise cancellation level. More specifically, the noise cancellation signal y(n) includes at least a first noise cancellation signal and a second noise cancellation signal, wherein the first noise compensation is a cancellation signal associated with the actual single-blade fundamental frequency and the second noise compensation is a cancellation signal associated with the actual BPF fundamental frequency.

In an embodiment, the adaptive filter 76 may process the calibrated reference signal x' (n) and the processed error signal e' (n) using least mean square (LMS) algorithm. However, the algorithm adopted by the adaptive filter 76 does not limit the scope of the present invention.

In conclusion, in the electronic system 100 of the present invention, the ANC controller 16 is configured to acquire the information related to narrow-band noises (such as the actual single-blade fundamental frequency or the actual BPF fundamental frequency) according to the error signal provided by the error microphone 50 and the fan information provided by the embedded controller 30. The micro speaker may be driven accordingly for providing the noise cancellation signal y (n) which cancels the noises generated during the operation of the electronic system 100. By adaptively adjusting the noise cancellation signal y (n) so as to reduce the error signal to zero, the present invention can address the issues of heat dissipation and noise reduction at the same time.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic system with heat dissipation and feed-forward active noise control function, comprising:

a fan module configured to operate according to a fan control signal for providing heat dissipation;

an embedded controller configured to provide the fan control signal and a synchronization signal which includes information associated with a structure and an operational setting of the fan module;

an error microphone configured to detect a noise level during an operation of the electronic system and output a corresponding error signal;

an active noise cancellation controller configured to:

acquire an actual single-blade fundamental frequency and an actual blade passing frequency (BPF) fundamental frequency of the fan module during operation; and provide a speaker control signal according to the actual single-blade fundamental frequency and the actual BPF fundamental frequency; and a micro speaker module configured to generate a cancellation noise signal according to the speaker control signal, wherein:

the cancellation noise signal includes a first noise compensation signal and a second noise compensation signal;

the first noise compensation is a cancellation signal associated with the actual single-blade fundamental frequency; and the second noise compensation is a cancellation signal associated with the actual BPF fundamental frequency.

2. The electronic system of claim 1, wherein the active noise cancellation controller comprises:

a frequency calculator configured to acquire an estimated single-blade fundamental frequency, an estimated single-blade overtone frequency, and an estimated BPF fundamental frequency;

a signal generator configured to generate a reference signal according to the estimated single-blade fundamental frequency, the estimated single-blade overtone frequency, and the estimated BPF fundamental frequency; and a digital filter configured to process the reference signal for determining a baseline power value of the speaker control signal.

3. The electronic system of claim 2, wherein the active noise cancellation controller further comprises:

an adaptive filter configured to adjust a parameter of the digital filter based on the reference signal and the error signal for adaptively adjusting a power value of the speaker control signal.

4. The electronic system of claim 3, wherein the adaptive filter is further configured to process the reference signal and the error signal using a least mean square (LMS) algorithm.

5. The electronic system of claim 3, wherein the active noise cancellation controller further comprises:

a secondary path compensation transfer function module coupled to the embedded controller for receiving an estimated signal of a secondary path and configured to provide a calibrated reference signal by calibrating the reference signal based on the estimated signal of the secondary path; and a noise weighting and conversion module configured to provide a processed error signal by processing the error signal using a signal weighting method and a signal conversion method, wherein the secondary path is associated with a signal transmission path between the micro speaker module and the error microphone; and the adaptive filter is further configured to adjust the parameter of the digital filter based on the calculated reference signal and the processed error signal.

6. The electronic system of claim 5, wherein the active noise cancellation controller further comprises:

a secondary path transfer function module configured to measure an actual frequency response of the secondary path and provide a calibrated cancellation noise signal by calibrating the cancellation noise signal according to the actual frequency response of the secondary path.

7. The electronic system of claim 5, wherein the active noise cancellation controller is further configured to adjust the parameter of the digital filter based on the calibrated reference signal and the processed error signal for adaptively adjust the power value of the speaker control signal and decreasing a value of the error signal.

8. The electronic system of claim 1, wherein the error microphone is disposed at an air outlet of the fan module.

9. The electronic system of claim 1, wherein the active noise cancellation controller is further configured to:

measure an actual frequency response of the signal transmission path between the micro speaker module and the error microphone; and provide a calibrated cancellation noise signal by calibrating the cancellation noise signal based on the actual frequency response of the signal transmission path between the micro speaker module and the error microphone.

10. The electronic system of claim 1, wherein the active noise cancellation controller is further configured to:

receive an estimated frequency response of a signal transmission path between the micro speaker module and the error microphone from the embedded controller; and provide a calibrated cancellation reference signal by calibrating the reference signal based on the estimated frequency response of the signal transmission path between the micro speaker module and the error microphone.

* * * * *